US006219975B1

(12) United States Patent
Olden

(10) Patent No.: US 6,219,975 B1
(45) **Date of Patent: *Apr. 24, 2001**

(54) TRUSS WITH INTEGRAL HOLD DOWN STRAP

(75) Inventor: Michael Marc Olden, Pacific, MO (US)

(73) Assignee: MiTek Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/079,910

(22) Filed: May 15, 1998

(51) Int. Cl.[7] ..... E04B 7/04

(52) U.S. Cl. ..... 52/92.2; 52/92.3; 52/93.1; 52/712

(58) Field of Search ..... 52/92.1, 92.2, 52/93.1, 93.2, 712, 714; 403/188, 402, 403

(56) References Cited

U.S. PATENT DOCUMENTS

| | | | | |
|---|---|---|---|---|
| 1,069,503 | * | 8/1913 | Wagner | 52/92.2 |
| 1,082,937 | * | 12/1913 | Douglass | 52/92.2 |
| 2,202,545 | * | 5/1940 | Webb | 403/188 |
| 3,184,800 | * | 5/1965 | Nelson | 52/92.2 |
| 3,298,151 | | 1/1967 | Jureit . | |
| 3,420,019 | * | 1/1969 | Padilla | 52/714 |
| 3,861,094 | | 1/1975 | Jureit et al. . | |
| 4,229,915 | * | 10/1980 | Snow et al. | 403/403 |
| 4,411,547 | | 10/1983 | Johnson . | |
| 4,713,923 | | 12/1987 | Sielaff et al. . | |
| 4,825,621 | | 5/1989 | Jensen . | |
| 5,150,982 | * | 9/1992 | Gilb | 52/712 |
| 5,257,483 | | 11/1993 | Netek . | |
| 5,303,520 | | 4/1994 | Gozdziak . | |
| 5,311,708 | | 5/1994 | Frye . | |
| 5,448,871 | | 9/1995 | Newman et al. . | |
| 5,497,591 | | 3/1996 | Nelson . | |
| 5,561,949 | | 10/1996 | Knoth . | |
| 5,735,087 | * | 4/1998 | Olden | 52/93.1 |
| 5,771,653 | * | 6/1998 | Dolati et al. | 52/93.1 |
| 5,857,306 | * | 1/1999 | Pellock | 52/712 |

FOREIGN PATENT DOCUMENTS

| | | |
|---|---|---|
| 2069024 | 8/1981 | (GB) . |
| 2138464 | 10/1984 | (GB) . |
| 2174122 | 10/1986 | (GB) . |
| 2185275 | 7/1987 | (GB) . |
| 2191520 | 12/1987 | (GB) . |

* cited by examiner

*Primary Examiner*—Michael Safavi
(74) *Attorney, Agent, or Firm*—Senniger, Powers, Leavitt & Roedel

(57) ABSTRACT

A truss, having an integral hold down strap, which can be attached to a wall of a structure. The truss contains an upper and lower chord and typically contains web members that extend between the upper and lower chords to provide strength and rigidity. The lower and upper chord converge at the heel of the truss and are connected by at least one nailing plate. The hold down strap is an elongate piece of sheet metal which is smooth and free of teeth, and has a first portion which contains two opposing flanges that are bent such that the first portion has a generally U-shaped cross section. The hold down strap also has a second portion sized to extend from the first portion and into engagement with one of the other structural components of a wall. The first portion of the hold down strap is sized to engage the end surface of the lower chord with the two opposing flanges engaging the side surfaces of the lower chord. The hold down strap is attached to the lower chord with a nailing plate, typically with the same nailing plate that connects the lower chord to the upper chord member.

8 Claims, 4 Drawing Sheets

TRUSS WITH INTEGRAL HOLD DOWN STRAP

FIELD OF THE INVENTION

This invention relates generally to trusses and more particularly, to a truss having an integral hold down strap.

BACKGROUND OF THE INVENTION

Structures which are occasionally subject to sustained high winds, such as structures located in regions subject to hurricanes, preferably have substantial connections between components of the structure to increase the strength of the structure and prevent damage in high winds. Building codes in these regions require that there be additional connections between trusses. in the roof, joists in the floor and the walls to anchor the roof and floor. For instance, it may be required to anchor each end of a truss or floor joist to the adjacent wall with a hold down strap.

It is well known to provide flexible metal straps for the purpose of connecting the roof truss (or floor joist) to a stud in an adjacent wall. An example of such a strap is shown in U.S. Pat. No. 3,861,094 (Jureit et al.). The Jureit et al. strap is an elongate piece of sheet metal formed at either end with teeth projecting outwardly from the sheet metal. Small, spaced apart sections are erupted from the sheet metal as by punching to define the teeth. The ends of the strap are driven into the truss and into a stud in the wall, respectively, to secure one to the other.

Toothed hold down straps can be hammered into the truss (or joist) and adjacent wall by laborers at the construction site. However, this is a time consuming process and often requires the laborers to get into precarious positions high up on the structure near the edge of the roof to secure the hold down straps to the wall. Moreover, the hold down straps must be stored by the laborers and then located when needed for securing the truss. It is known to secure one end of a toothed strap to the truss at a plant where the truss is assembled so that the strap is integrated with the truss prior to erecting the truss on the wall of the structure. The end of the toothed hold down strap can be pressed into the truss by the same press used to drive other nailing plates into adjoining wooden elements forming the truss. At the construction site, the laborer need only secure the other end of the strap to an adjacent stud.

The sheet metal must be sufficiently strong so that the teeth formed can be driven into the wooden elements of the truss or joist and the wall. There must be enough thickness in the sheet material so that teeth punched from the sheet material will not simply bend over rather than penetrating the wood of the truss components when pressed against them. Sheet material having this thickness (e.g., 22 gauge sheet metal) is thicker than needed to adequately secure the truss to the wall. Thus, the cost of the straps is high because the sheet metal must be quite heavy so that teeth formed are of sufficient strength. Further, the formation of the teeth in the hold down straps is an additional step in the construction process, whether the hold down straps are secured to the truss at the construction site or at the assembly plant. The tooth formation step, which is in addition to the step of stamping out the hold down straps from a web of sheet metal, also adds to the cost of the truss. Thus, it would be desirable to have a truss assembly with an integral hold down strap that is easily fastened to a wall and is inexpensive to manufacture.

SUMMARY OF THE INVENTION

These and other objects may be obtained by a truss, having an integral hold down strap, which is used with other structural components, such as wall studs and the like, to form a structure. The truss contains an upper and lower chord and typically contains web members that extend between the upper and lower chords to provide strength and rigidity. The web members and the chords are connected to each other by nailing plates. The lower and upper chord converge at the heel of the truss and are connected by at least one nailing plate. A web member, such as a polygonal block, may be located between the upper and lower chord at the heel of the truss.

The hold down strap in one embodiment is an elongate piece of sheet metal which is smooth and free of teeth. The strap has a first portion which contains two opposing flanges that are bent such that the first portion has a generally U-shaped cross section. The hold down strap also has a second portion sized to extend from the first portion and into engagement with one of the other structural components, such as a stud or a wall top plate. The first portion of the hold down strap is sized to engage the end surface of the lower chord with the two opposing flanges engaging the side surfaces of the lower chord. The hold down strap is attached to the lower chord with a nailing plate, typically with the same nailing plate that connects the lower chord to the upper chord or the lower chord to the polygonal block web member.

The hold down strap is free of integrally formed teeth which eliminates the fabrication step of punching out the teeth. Typically, for integrally formed teeth to be effective and not bend during installation, the teeth must be formed from thick metal, usually at least 22 gauge. Because the hold down strap is free of integral teeth, the strap may be fabricated from thinner sheet metal. The use of thinner steel, typically 26 gauge, reduces cost. Also, the use of 26 gauge steel promotes quick and easy attachment to the truss by the same nailing plate that is used to connect the lower and top chords because the integrally formed teeth of the nailing plate can easily penetrate the thin sheet metal of the brace.

DETAILED DESCRIPTION

Figure 1:
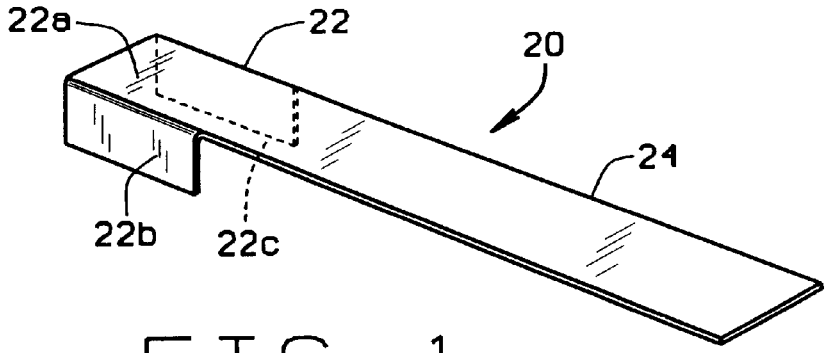
FIG. 1 is an enlarged perspective view of a hold down strap in accordance with one embodiment of the present invention.

FIG. 1 is a perspective view of a hold down strap 20 which is an elongate piece of sheet metal having a first portion 22 and a second portion 24. First portion 22 has a central region 22*a* and a pair of flanges 22*b* and 22*c* located on opposite longitudinal edges of central region 22*a*. Flanges 22*b* and 22*c* are bent downwardly so that first portion 22 of hold down strap 20 has a generally (inverted)

U-shaped cross section. The transverse dimension of central region 22*a* is approximately equal to the transverse dimension of second portion 24 of hold down strap 20.

Figure 2:
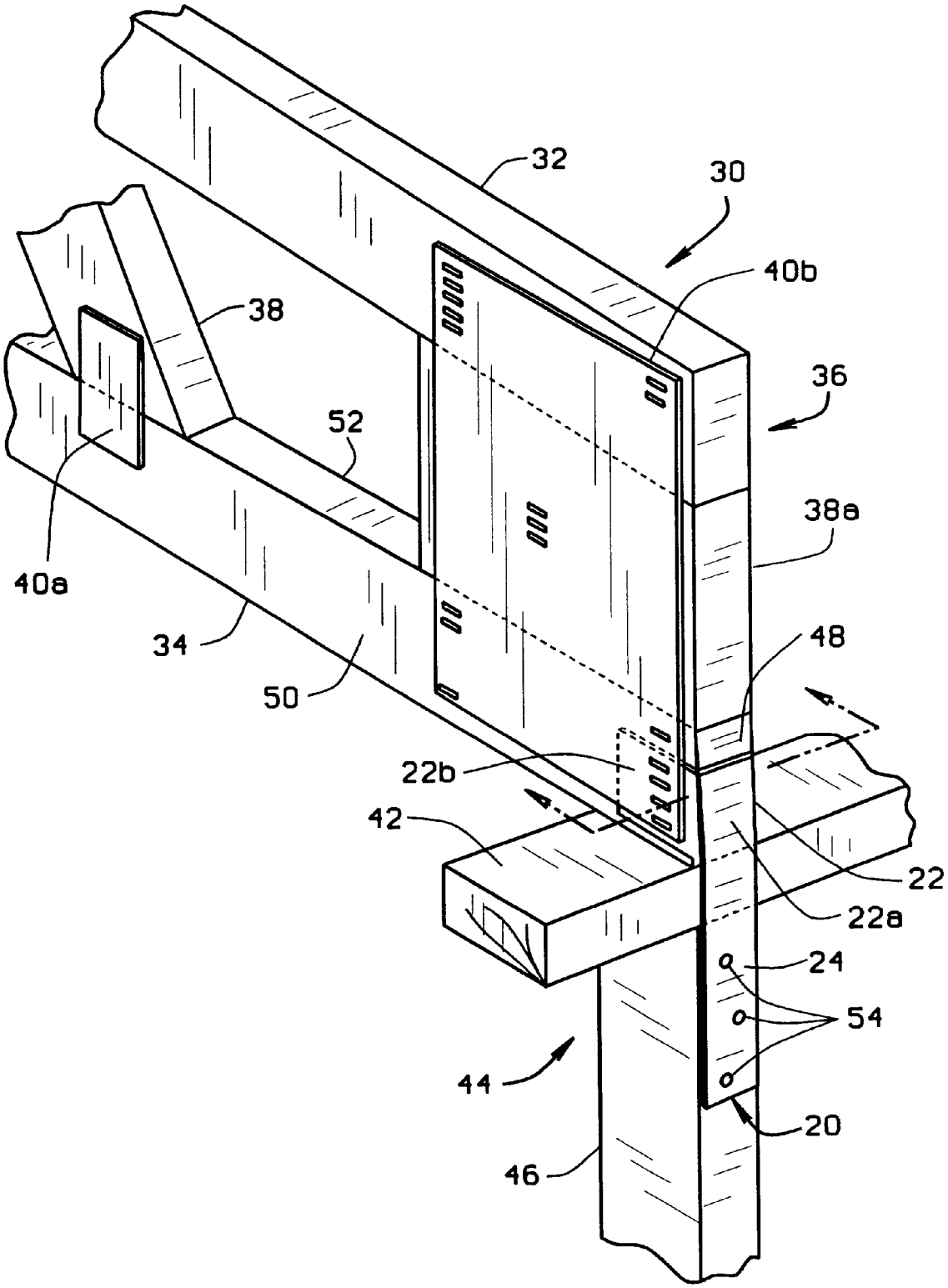
FIG. 2 is a fragmentary perspective showing connection of a truss having an integral hold down strap to the stud in a wall of a structure.

FIG. 2 is a fragmentary perspective view of a truss 30 having an integral hold down strap 20. Truss 30 has an upper chord 32 and a lower chord 34 which generally converges with upper chord 32 toward a heel 36 of truss 30. Web members 38 (including a polygonal block 38*a* located at heel 36) extend between upper chord 32 and lower chord 34 providing additional strength and rigidity. Upper chord 32, lower chord 34 and web members 38 are connected to each other by nailing plates 40 (including nailing plates 40*a* and 40*b* illustrated in FIG. 2) in a manner well known to those of ordinary skill in the art. Each chord 32 and 34 and web member 38 may be formed from one or more pieces of wood or other suitable material. Truss 30 as described thus far is of conventional construction. The present invention has application to all types of trusses, including without limitation flat trusses, as well as to other structural components, such as floor joists.

Lower chord 34 at heel 36 rests on a top wall plate 42 of a wall 44. Top wall plate 42 is supported by studs 46 (only one is shown) in a conventional manner. An end surface 48 of lower chord 34 is received between flanges 22*b*, 22*c* of hold down strap 20 so that central region 22*a* of first portion 22 of hold down strap 20 lies in face-to-face engagement with end surface 48. Flanges 22*b*, 22*c* lie in generally face-to-face engagement with corresponding side surfaces 50 and 52 of lower chord 34 which are generally perpendicular to the end surface 48. A second portion 24 of hold down strap 20 extends downwardly from end surface 48 around top wall plate 42 to stud 46 to which it is secured such as by nails 54. When second portion 24 of hold down strap 20 is secured to stud 46, it functions to hold heel 36 of the truss 30 down on wall 44. A substantially identical hold down strap (not shown) holds down the opposite end of the truss 30 so that the entire truss is secured to the structure by the hold down straps 20.

Figure 3:
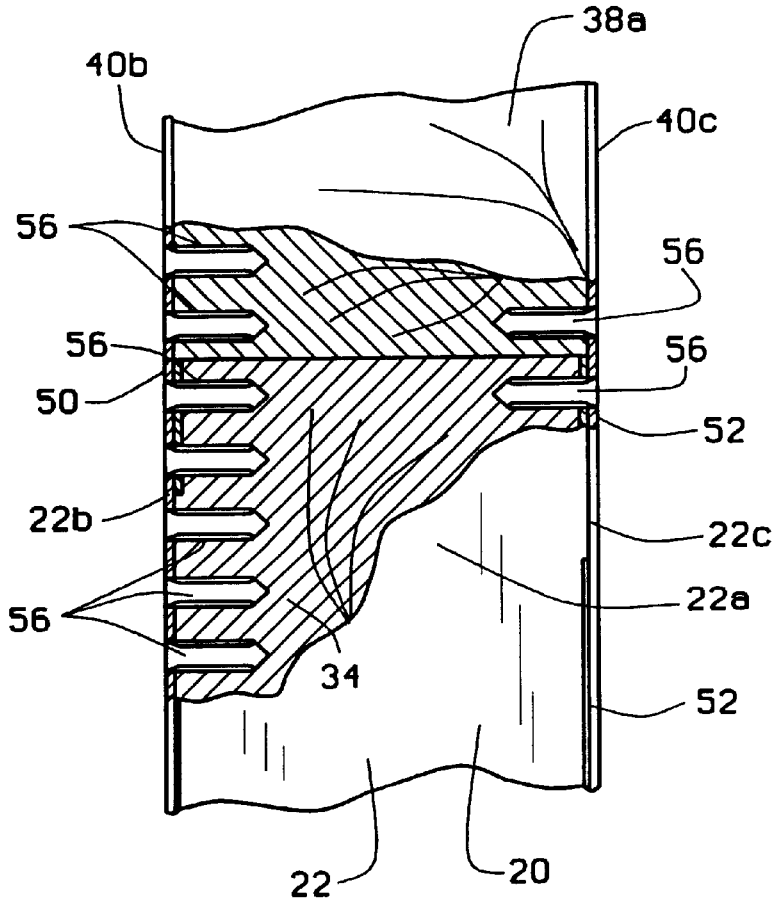
FIG. 3 is an enlarged fragmentary right end elevation of the truss of FIG. 2 as seen from the vantage indicated by line A—A of FIG. 2 and illustrating the penetration of teeth from a nailing plate through the hold down strap and into the truss.

Referring now to FIG. 3, nailing plate 40*b* connects lower chord 34, block 38*a* and upper chord 32 together at heel 36 of the truss 30. Teeth 56 of nailing plate 40*b* penetrate through flange 22*b* of hold down strap 20 and into side surface 50 of lower chord 34. The penetration of flange 22*b* fixedly secures the hold down strap 20 to the truss 30 at the heel. Teeth 56 extend parallel to the plane of first portion 22 of hold down strap 20 which is lying in face to face contact with end surface 48 of lower chord 34. Hold down strap 20 is preferably free of any other connection to the truss except by nailing plates 40*b* and 40*c*.

Figure 4:
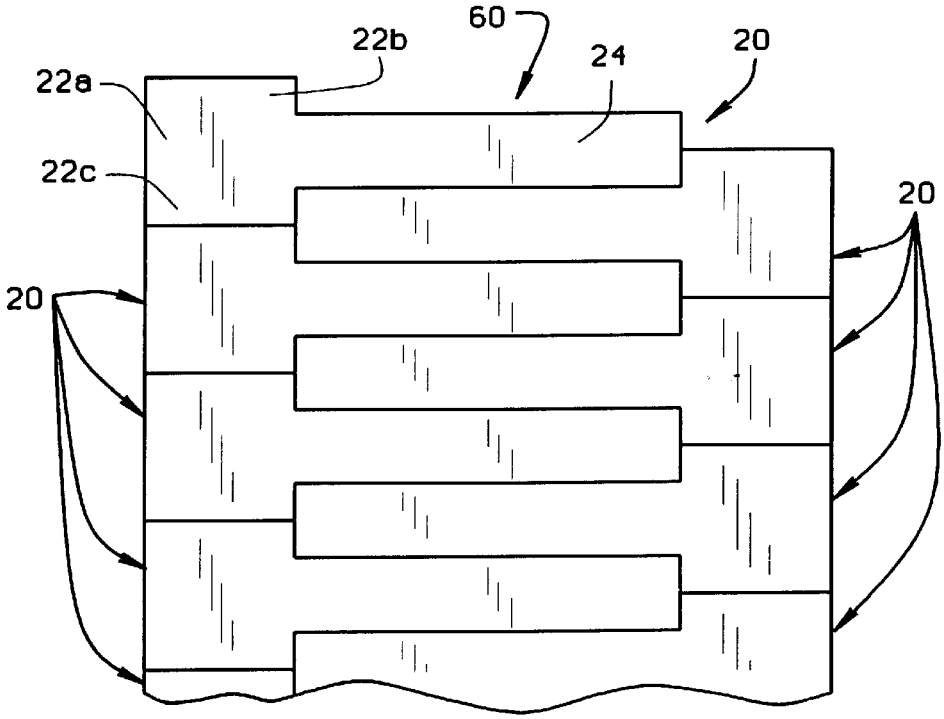
FIG. 4 is a plan view of hold down straps stamped from a strip of sheet metal prior to separation.

As shown in FIG. 4, hold down strap 20 may be fabricated by stamping as one piece from a strip 60 of sheet metal along with other hold down straps 20. Flanges 22*b*, 22*c* of hold down strap 20 are sized so that all of the material in strip 60 of sheet metal is used. In one embodiment, hold down straps 20 are formed from 26 gauge sheet metal. Sheet metal of other thicknesses may be used so long as the metal is sufficiently thick to meet building code requirements and sufficiently thin to permit penetration by standard nailing plates, which are typically formed from 20 gauge sheet metal. The sheet material of hold down strap 20 is smooth, flat and free of teeth formed therein both before and after formation of hold down strap 20. As stamped from strip 60, hold down strap 20 of one embodiment is 15 inches long, 1.5 inches wide along second portion 38 and 3 inches wide at flanges 22*b*, 22*c* prior to their being folded down. When flanges 22*b* and 22*c* are folded down, central region 22*a* has a transverse dimension of about 1.5 inches which will receive the narrower side of a 2×4 or a 2×10. Of course, the dimensions of hold down strap 20 may be other than described without departing from the scope of the present invention.

In use, hold down strap 20 is attached to heel 36 of truss 30. End surface 48 of lower chord 34 is received between flanges 22*b* and 22*c* so that central region 22*a* lies in face-to-face engagement with end surface 48. Flanges 22*b* and 22*c* are attached to chord side surfaces 50 and 52 respectively by nailing plates 40. Second portion 24 of strap 20 extends downwardly form end surface 48. To secure truss 30 to wall 44, second portion 24 is secured to stud 46 with nails 54.

Integral hold down strap 20 thus is used to anchor truss 30 to wall 44 to provide increased structural strength to resist extreme environmental conditions such as high winds and the like. Hold down strap 20 is easily attached to truss 30 during truss construction with nailing plates 40. Hold down strap is free of integrally formed teeth and as such may be fabricated from relatively thin sheet metal, typically 26 gauge, which reduces cost. The use of thin gauge steel permits easy installation to truss 20 with nailing plates 40 because teeth 56 of nailing plate 40 can easily penetrate strap 20.

Figure 5:
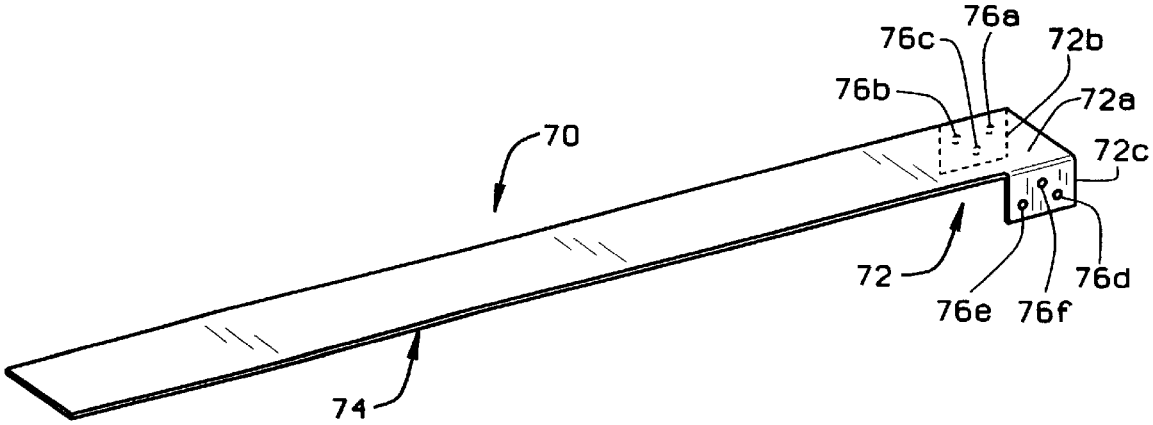
FIG. 5 is an perspective view of a hold down strap in accordance with another embodiment of the present invention.

FIG. 5 illustrates a held down strap 70 in accordance with another embodiment of the present invention. Strap 70 is an elongate piece of sheet metal having a first portion 72 and a second portion 74. First portion 72 has a central region 72*a* and a pair of flanges 72*b* and 72*c* located on opposite longitudinal edges of central region 72*a*. Flanges 72*b* and 72*c* are bent downwardly so that first portion 72 of hold down strap 70 has a generally (inverted) U-shaped cross section. The transverse dimension of central region 72a is approximately equal to the transverse dimension of second portion 74 of hold down strap 70. Flange 72*b* includes engagement holes 76*a*, 76*b*, and 76*c*, and flange 72*c* includes engagement holes 76*d*, 76*e*, and 76*f*. Engagement holes 76*a*, 76*b*, 76*c*, 76*d*, 76*e*, and 76*f* are configured to permit teeth 56 of nailing plates 40 (shown in FIG. 3) to penetrate flanges 72*b* and 72*c*.

Hold down strap 70 may be fabricated by stamping as one piece from a strip of sheet metal along with other hold down straps 70 in a manner similar to that described above for fabricating hold down strap 20. Engagement holes 76*a*, 76*b*, 76*c*, 76*d*, 76*e*, and 76*f* may be punched out during the stamping process by punch out dies in the stamping press as is well known in the art.

Figure 6:
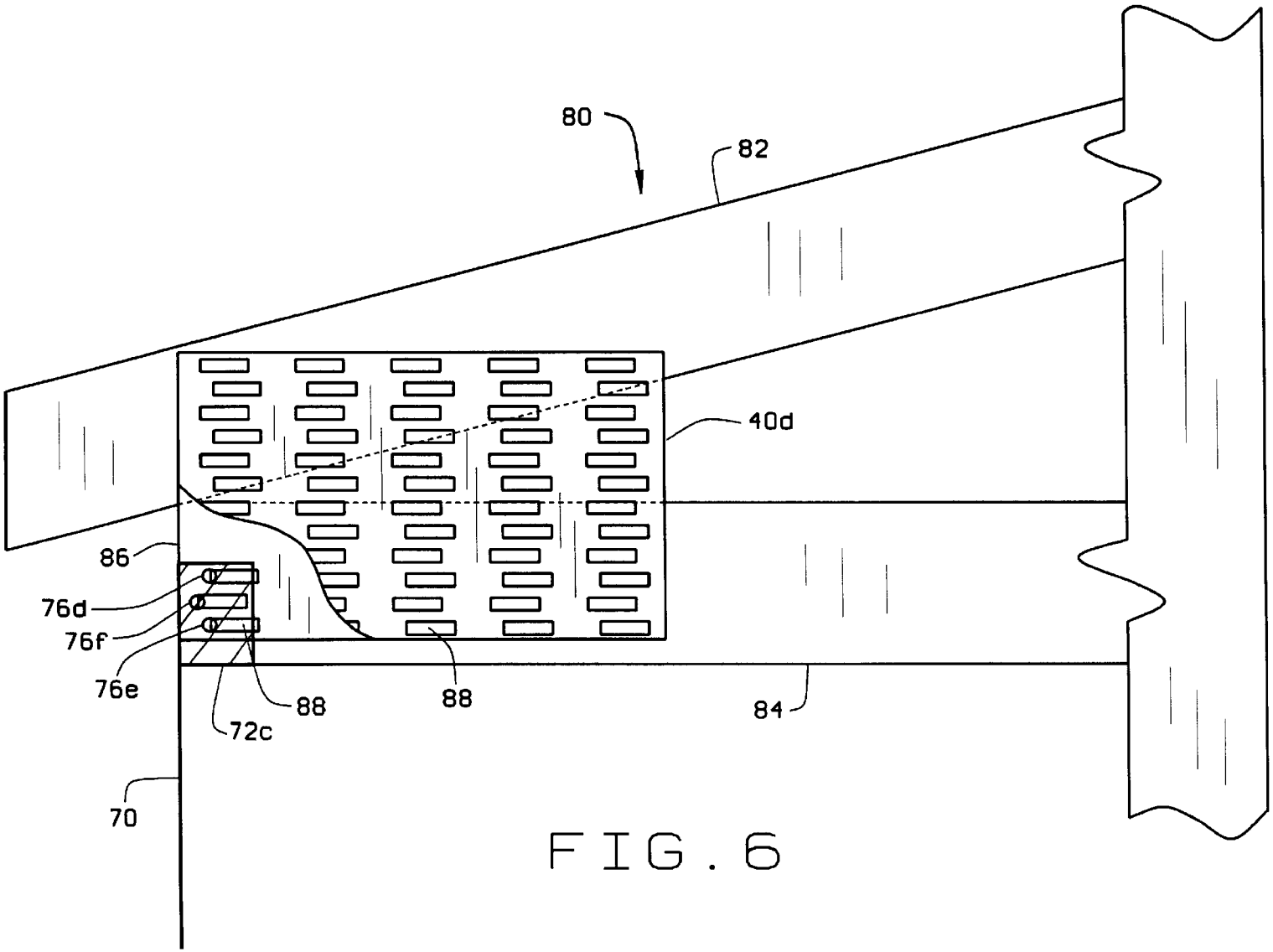
FIG. 6 is a fragmentary side view showing a truss having the integral hold down strap shown in FIG. 5.

FIG. 6 shows a portion of a truss 80 including upper chord 82 and lower chord 84. Upper chord angularly intersects lower chord 84 at end 86 of lower chord 84. Nailing plate 40*d* connects upper chord 82 to lower chord 84. Hold down strap 70 is attached to end 86 of lower chord 84 by nailing plate 40*d*. Nailing plate 40*d* includes a plurality of teeth 56 (shown in FIG. 3) integrally formed by conventional punching processes which leave an open slot 88 having a tooth 56 projecting down at each end of slot 88.

Engagement holes 76*d*, 76*e*, and 76*f* are located in flange 72*c* so that when nailing plate 40*d* is positioned over flange 72*c*, lower chord 84, and upper chord 82, three of teeth 56 substantially align with holes 76*d*, 76*e*, and 76*f*. The alignment of holes 76*d*, 76*e*, and 76*f* and teeth 56 provide easy penetration of flange 72*c* by teeth 56 to secure hold down strap 70 to truss 80.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A truss for use with other structural components to form a structure, the truss comprising:

an upper and lower chord, each said chord having an upper and lower surface, an end surface and two opposing side surfaces, at least one nailing plate having teeth which extend generally perpendicularly outwardly from said nailing plate, and a hold down strap, wherein said lower chord converges with said upper chord at a heel of said truss and are connected by said nailing plates such that some teeth of said nailing plate penetrate a side surface of said lower chord and other teeth of said nailing plate penetrate the corresponding side surface of said upper chord, and wherein said hold down strap comprises a first portion having two opposing flanges and a central region, sized to engage said end surface of said lower chord such that said central region is in face to face engagement with said end surface of said lower chord and said two opposed flanges are in face to face engagement with said opposing side surfaces of said lower chord and attached to said side surfaces with said nailing plates, and a second portion sized to extend from said first portion and into engagement with one of the other structural components for connection to the other structural component to secure said truss to the other structural component.

2. A truss in accordance with claim 1 additionally comprising web members wherein said web members extend between said upper and lower chords and are connected to said upper and lower chords by said nailing plates.

3. A truss in accordance with claim 1 wherein at least some of said teeth of said nailing plate pass through a flange of said hold down strap and a side surface of said lower chord, and other teeth of said nailing plate penetrate a corresponding side surface of said upper chord.

4. A truss in accordance with claim 1 wherein said hold down strap is made of sheet metal of a first gauge and said nailing plate is made of sheet metal of a second gauge thicker than the first gauge.

5. A truss in accordance with claim 4 wherein the sheet metal of said hold down strap is 26 gauge.

6. A truss in accordance with claim 1 wherein said hold down strap is free of connection to said lower chord except by said nailing plates.

7. A truss in accordance with claim 1 wherein said opposing flanges of said first portion comprise a plurality of engagement holes.

8. A truss in accordance with claim 7 wherein each said flange comprises three engagement holes configured to substantially align with three teeth of said nailing plate.

* * * * *